United States Patent [19]

Kaiser et al.

[11] 4,005,631

[45] Feb. 1, 1977

[54] DEVICE FOR SETTING MECHANICAL TIME FUSES

[75] Inventors: Hans Kaiser, Konigsfeld; Arthur Kopf; Josef Müller, both of Schramberg, all of Germany

[73] Assignee: Gebruder Junghans GmbH, Schramberg, Germany

[22] Filed: Oct. 21, 1974

[21] Appl. No.: 516,417

[30] Foreign Application Priority Data

Oct. 23, 1973 Germany ..... 2352967

[52] U.S. Cl. ..... 89/6.5; 102/83

[51] Int. Cl.[2] ..... F42C 17/00

[58] Field of Search ..... 89/6, 6.5; 102/83, 84

[56] References Cited

UNITED STATES PATENTS

| | | | |
|---|---|---|---|
| 2,415,362 | 2/1947 | Midgley | 89/6.5 |
| 2,419,102 | 4/1947 | Whitehead | 89/6 |
| 2,427,895 | 9/1947 | Borden | 89/6 |
| 2,450,553 | 10/1948 | Jorgensen | 89/6.5 |
| 2,531,488 | 11/1950 | Wolf | 89/6 X |
| 2,792,759 | 5/1957 | Campbell et al. | 89/6 |
| 3,371,579 | 3/1968 | Kinzelman | 89/6 |

*Primary Examiner*—David H. Brown
*Attorney, Agent, or Firm*—Walter Becker

[57] ABSTRACT

A device for setting mechanical time fuse in which the fuse has an element which, when rotated, adjusts the time period of the fuse. The fuse is contained within a housing at the forward end of a projectile and within the housing forwardly of the fuse is a stepping motor connected to the rotatable element of the fuse by reduction gearing. A setting device in the form of a pulse emitter and adjustable logic circuitry is disposed outside the firing tube in which the projectile is mounted and is electrically connected with the stepping motor by wires which include separable connectors. The setting device advantageously provides for ignition of the projectile propelling charge when the setting of the time period for the fuse has been completed. Also, advantageously, a clamping device is provided for clamping the stepping motor in its adjusted position prior to or immediately upon ignition of the propelling charge.

7 Claims, 4 Drawing Figures

DEVICE FOR SETTING MECHANICAL TIME FUSES

The present invention relates to a setting device for mechanical time fuses, the ignition time point of which is adapted to be preset by turning a setting disc or the like relative to the driving and feeling elements therefor. With projectiles equipped with a mechanical time fuse, the setting of the time mechanism is effected directly prior to the introduction of the projectile into the barrel and, more specifically by means of a fuse setting device, by manually or mechanically turning a setting disc or the like in conformity with the rated flight duration and distance. Once the projectile is in the firing barrel or tube, the time setting cannot any longer be changed unless the projectile is removed.

With time fuses equipped with electrically or electronically working ignition delay devices, it is known to adapt to the distance of the aim the time constant, for instance of a reversing circuit, by a control device arranged outside the firing barrel, until directly prior to the firing of the projectile. In other words, it is known to set the time constant in conformity with the rated flight time. As conveying medium there are primarily used control lines. However, also devices have been suggested according to which the electronic setting is effected at the instant of the firing, in part even after the firing namely when the projectile is leaving the mouth of the barrel. The transmission of the setting order is in this connection effected primarily inductively through a coil arranged at the mouth of the barrel, by means of which coil the setting pulses or the like are conveyed in a wireless manner to the projectile passing said coil or to the fuse for the projectile.

In spite of this advantage of electronic fuses, in many instances the mechanical time fuse is preferred, not only because it is more temperature sensitive and less aging sensitive, but above all because it cannot be influenced by interference fields or beams and because it does not require a source of current or battery.

It is an object of the present invention to provide a mechanical time fuse with a setting device corresponding to the electronic setting of an electronic fuse, by means of which the fuse of the projectile in the firing tube or barrel is adapted to be set until the driving charge ignites.

These and other objects and advantages of the invention will appear more clearly from the following specification in connection with the accompanying drawings, in which.

Figure 2:
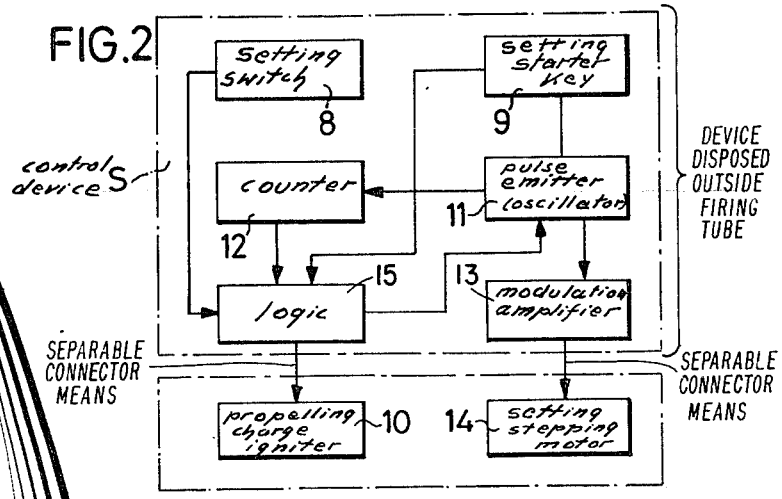
FIG. 2 is a block diagram of a control device according to the present invention with a setting device connected thereto.
Figure 2A:
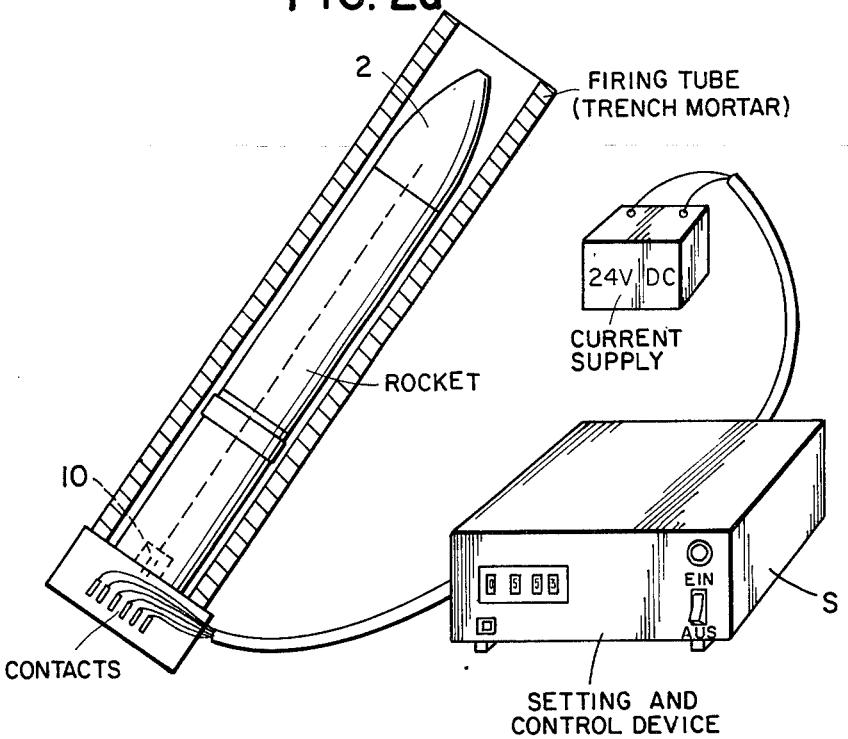

FIG. 2*a* provides perspective illustration of the setting device and firing tube.

Figure 1:
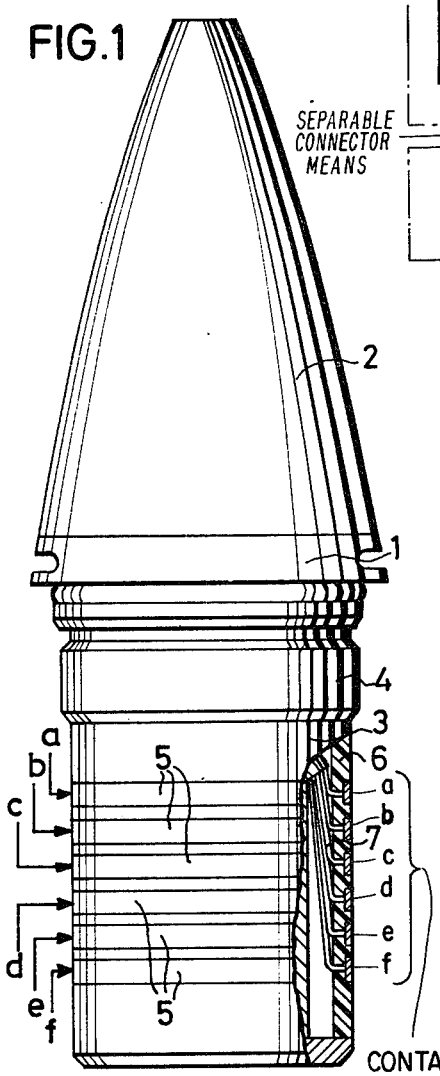
FIG. 1 is a side view of a time fuse partially in section.
Figure 3:
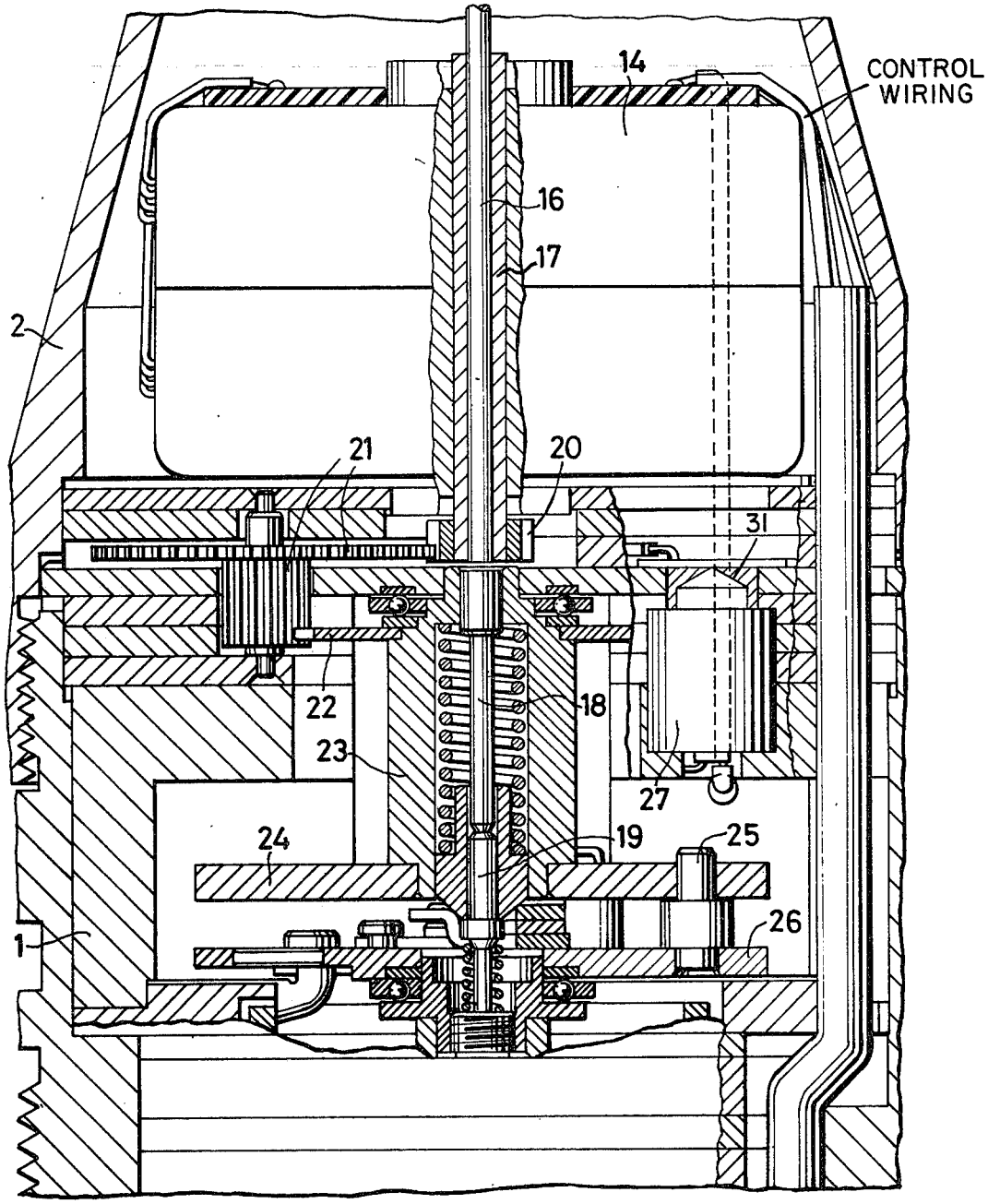

FIG. 3 illustrates on a larger scale than FIG. 1 a longitudinal section through the head portion of the time fuse according to FIG. 1 with a setting device according to the invention.

Figure 4:
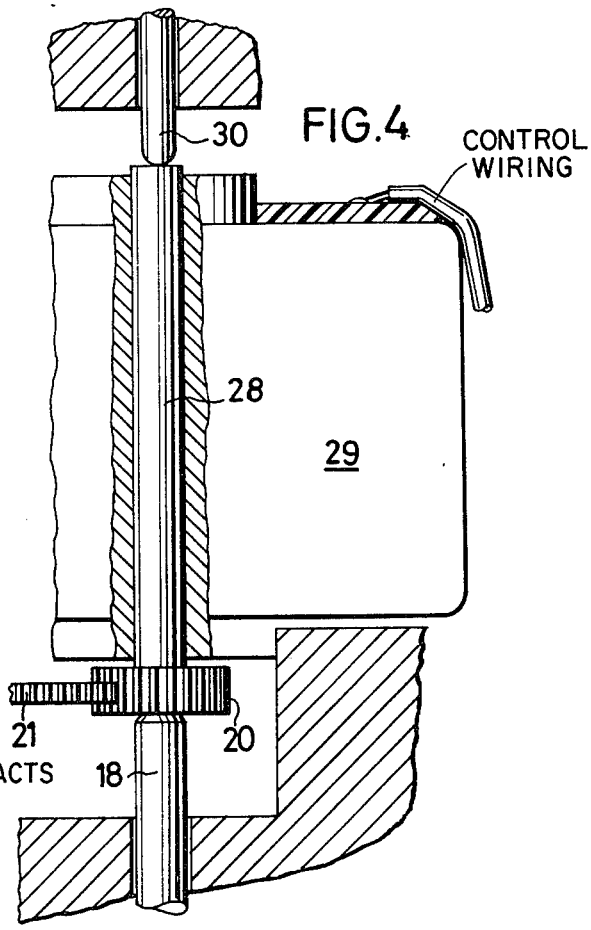

FIG. 4 represents another embodiment of a portion of the setting device according to FIG. 3.

The setting device for mechanical time fuses, according to the present invention is characterized primarily in that the setting device has for setting the same associated therewith a setting element which is arranged inside the barrel and operates electro-mechanically while being coupled kinematically to the setting device, preferably a setting disc, said setting element being operable through control lines by means of a control device arranged outside said barrel.

The setting-control device may comprise a pulse emitter for generating advancing pulses actuating said control element, and may further comprise a selector switch or the like for presetting the steps corresponding to the duration of the flight, and also may have a setting-starting key for starting the control device. The setting-control device furthermore may comprise a setting-starting key for starting the control device, a pulse counter connected to the pulse emitter, and a logic operatively connected to the above mentioned structural elements. The said logic is adapted after actuation of the starting key and after effected setting of the time mechanism stops the setting element and the setting device and emits an ignition pulse to a driving charge fuse of the projectile.

The setting element is preferably arranged in the fuse with means at the tip thereof and after the projectile has been inserted into the firing tube or barrel may through the intervention of contact surfaces or rings inserted into the fuse and body of the projectile be connected to the control device which is located outside the firing barrel. A driving shaft of the adjusting element may be arranged along the axis of the fuse coaxial to an ignition pin.

According to another embodiment of a device for solving the above outlined problems, the driving shaft itself may be rotatably and axially displaceably arranged in the fuse and may be provided between an impact push rod and the ignition needle.

The setting element is preferably an electric motor, especially a stepping motor which through an intermediate transmission engages the setting disc or the like of the setting device.

By means of this setting device according to the invention, also a mechanical time fuse in the firing tube or barrel may be set or post set up to the time directly prior to the firing. By a corresponding design or arrangement of the control setting device, any loss in time between the setting of the time mechanism and the release of the igniter for igniting the propelling charge will be avoided.

Referring now to the drawings in detail, and FIG. 1 thereof in particular, a fuse body 1, the head portion of which is equipped with a fuse hood 2 has on a shank 3 below a thread 4 a number of contact rings 5 which are inserted into a mantle 6 of insulating material. These contact rings 5 are through wire connections 7 connected to a setting device which is more clearly shown in FIG. 3. The connection of the contact rings 5 toward the outside is effected in customary manner by contact nipples or tongues which in FIG. 1 are indicated by the arrows *a,b,c,d,e,f*.

In a block diagram illustrated in FIG. 2, a setting selector switch is designated with the numeral 8 while the numeral 9 indicates a setting-starting key. The block diagram of FIG. 2 furthermore comprises a driving charge fuse 10, a pulse emitter or oscillator 11, a counter 12, a modulation amplifier 13, a setting stepping motor 14 and a logic 15. The structural elements 8, 9, 11, 12, 13, 15, plus a non-illustrated current supply unit are mounted in a control device S arranged outside the firing tube or barrel. This control device S may for instance be associated with a command device and a flight path calculator of the weapon. The structural elements 10 and 14 are with the weapon in charge condition located within the barrel, and the propelling charge igniter 10 is at the propelling charge, while the stepping motor 14 is in the igniter body 1.

By means of the setting selector switch 8, the number of the setting steps is adapted to be set. The overall setting range is divided for instance in 9999 individual steps or pulses. When setting the setting selector switch 8, no control or setting operation occurs at the fuse. This presetting may be effected prior to and after the charging of the weapon. If desired, the projectile may also without any danger be withdrawn again from the firing tube or barrel.

When the projectile has been introduced into the firing tube or barrel, it is possible by actuating the setting starter key 9, to initiate the setting operation. This setting operation ends without any intermission with the ignition of the propelling charge by means of the propelling charge igniter 10. When actuating the setting-starter key 9, the pulse emitter 11 designed as an oscillator is put into operation. The pulses of said plate emitter 11 are on one hand conveyed to the counter 12 and on the other hand to the modulation amplifier 13 and from the latter by means of corresponding conductors and the contact tongues *a–f*, FIG. 1, as well as the contact rings 5 conveyed to the stepping motor 14. When depressing the key 9, simultaneously the logic 15 is activated. This logic compares the number of pulses emitted by the pulse emitter 11 with the preset number of pulses set by means of the setting-selector switch 8. When both numbers of pulses coincide, the logic releases the stopping pulse to the pulse emitter 11 as a result of which the stepping motor 14 remains in the pre-selected set position. Simultaneously, however, the logic also conveys an ignition tension push to the propelling charge igniter 10. The projectile will thus be fired without any delay. The key 9 consequently simultaneously functions as fire command key. The setting itself will, depending on the distance of the aim, require a few tenths up to two seconds.

Instead of automatically coupling the setting and the firing, it is a matter of course that the setting may also be controlled for instance by a command device and could continuously in conformity with the calculated value be corrected, and the firing could after effected settings be effected separately. After the projectile has been fired, the weapon may immediately be recharged again and the next following projectile may be set and fired in the same or a changed position of the selector switch 8 by depressing the starter key 9.

According to FIG. 3, the stepping motor 14 for adjusting the setting device is arranged at the tip of the fuse body 1 and is covered by the fuse hood 2. For receiving the transmission push rod 16, which in a manner known per se extends forwardly into the range of an impact head or carries the latter itself, there is provided a shaft 17 of the stepping motor 14 which shaft is designed as a hollow shaft. The above mentioned transmission push rod 16 is mounted on a further transmission push rod 18 which in its turn rests on the stern of an ignition pin 19 and during an axial push from the transmission push rod 16 pushes the ignition pin 19 in a manner known per se into a detonator not illustrated.

To the hollow shaft 17 is connected a pinion 20 which through the intervention of an intermediate compound gear 21 is drivingly connected to a gear 22. This gear 22 is positively connected to a bushing 23 which is coaxial with the fuse axis. At the other end of gear 22 there is arranged a transmission disc 24. A follower bolt 25 connects the transmission disc 24 with a setting disc 26 for setting the fuse time. This disc 26 is associated with a customary setting device.

The stepping motor 14 for setting the setting device is in the illustrated embodiment shown as a multi-phase step motor which receives its current through the contact rings 5 shown in FIG. 1. The four-phase motor illustrated in the embodiment makes with a single step a revolution of 7½° and a complete revolution at 48 pulses. After the said four-phase motor is adapted to be controlled at 500 pulses per second, with the stepped down ratio of the intermediate transmission shown by way of example for a complete revolution of the setting disc 26, 800 steps, i.e., 800 pulses, are required. The only theoretically obtainable maximum time thus amounts to 1.6 seconds.

In addition to the stepping motor 14 itself, also through an additional contact ring 5 there is controllable a rotation safety device of the stepping motor 14, preferably likewise by means of pulse emission. As relay element there serves preferably a blocking and releasing element 27 operable by a pressure gas cartridge. The element 27 engages by means of a blocking bolt 31 the drive of the setting device. Instead of the blocking latch releaseable by pressure gas, the safety device may also be designed as electromagnetic barrier or the like which is releasable during the firing.

According to the embodiment of FIG. 3 the shaft of the stepping motor 14 is designed as hollow shaft 17 in which the transmission push rod 16 is axially displaceably guided. According to the embodiment of FIG. 4 a shaft 28 of the stepping motor 29 is designed as a solid shaft but is axially so displaceable and so mounted between the head push rod 18 and the ignition pin or primer 18 that in itself serves as transmission push rod during the impact at the aim or goal.

It is, of course, to be understood that the present invention is, by no means, limited to the specific showing in the drawing but also comprises any modifications within the scope of the appended claims.

What is claimed is:

1. In combination with an apparatus for adjusting a mechanical time fuse for a projectile in which a rotatable element is provided for adjusting the time period of the fuse; a housing forming a part of the projectile associated with the fuse, an electric motor in the housing coupled to the rotatable element to rotate the element, a setting device for the motor to rotate the motor to a predetermined rotated position to adjust the rotatable element thereby to set the fuse to a desired time period, said setting device being disposed outside the firing tube in which the projectile is disposed, and control wires leading from said setting device to said motor subject to including separable connector means therebetween.

2. An apparatus in combination according to claim 1 in which said motor is a stepping motor, said setting device includes pulse emitting means and means for controlling the number of pulses emitted to said motor including a counter and logic circuit means, a starting switch in said setting device and means operable by said logic circuit means after the setting of the fuse has been completed for igniting the propelling charge for said projectile.

3. An apparatus in combination according to claim 1 in which said motor is coaxially arranged with the fuse in said housing.

4. An apparatus in combination according to claim 1 in which said motor is a stepping motor and reduction gearing connecting said motor to the rotatable element.

5. An apparatus in combination according to claim 1 in which said motor is coaxially arranged with the fuse in said housing, and rod means axially moveable in the motor on the axis thereof and disposed between an impact push rod at the forward end of the housing and an ignition pin on the axis of the fuse.

6. An apparatus in combination according to claim 5 in which said rod means is the shaft of the motor.

7. An apparatus in combination according to claim 5 in which the shaft of the motor is hollow and said rod means is reciprocable in said shaft.

* * * * *